US007730845B1

(12) United States Patent
Kulp et al.

(10) Patent No.: US 7,730,845 B1
(45) Date of Patent: Jun. 8, 2010

(54) VERTICAL PANEL TRAFFIC CHANNELIZER

(75) Inventors: Jack H. Kulp, Dana Point, CA (US); Felipe Almanza, Perris, CA (US); Geoffrey B. Maus, Mission Viejo, CA (US)

(73) Assignee: Traffix Devices, Inc., San Clemente, CA (US)

( * ) Notice: Subject to any disclaimer, the term of this patent is extended or adjusted under 35 U.S.C. 154(b) by 11 days.

(21) Appl. No.: 11/715,278

(22) Filed: Mar. 7, 2007

Related U.S. Application Data

(60) Provisional application No. 60/780,087, filed on Mar. 7, 2006, provisional application No. 60/898,202, filed on Jan. 29, 2007.

(51) Int. Cl.
*E01F 9/00* (2006.01)
*E01F 9/012* (2006.01)

(52) U.S. Cl. ..... 116/63 P; 116/63 R; 404/9

(58) Field of Classification Search ..... 116/63 R, 116/63 P, 63 C, 63 T; 404/6, 9, 10; 40/903
See application file for complete search history.

(56) References Cited

U.S. PATENT DOCUMENTS 4,298,292 A * 11/1981 Sweeney ..... 404/10
5,168,827 A * 12/1992 Junker ..... 116/63 P
5,670,954 A * 9/1997 Junker ..... 340/908.1
5,685,255 A * 11/1997 Arzu ..... 116/30
5,749,673 A 5/1998 Kulp et al.
5,775,833 A * 7/1998 Little ..... 404/9
5,860,386 A * 1/1999 Schwab et al. ..... 116/63 P
6,095,716 A 8/2000 Kulp et al.
6,109,820 A * 8/2000 Hughes, Sr. ..... 404/10
6,186,699 B1 2/2001 Kulp et al.
6,233,898 B1 * 5/2001 Burlando ..... 404/9
6,305,312 B1 10/2001 Bent et al.
6,402,422 B1 6/2002 Gertz et al.
6,508,195 B1 * 1/2003 Tipaldo ..... 116/63 P
6,520,712 B2 2/2003 Kulp et al.
6,659,681 B1 * 12/2003 Kulp et al. ..... 404/9
6,840,707 B1 1/2005 Kulp et al.
7,057,530 B2 * 6/2006 Young ..... 340/908
7,476,051 B1 * 1/2009 Kulp et al. ..... 404/9

* cited by examiner

*Primary Examiner*—Amy Cohen Johnson
(74) *Attorney, Agent, or Firm*—Stout, Uxa, Buyan & Mullins, LLP; Donald E. Stout

(57) ABSTRACT

A vertical panel delineator system is capable of withstanding high winds without rotating from a preferred orientation wherein the full width of the device is perpendicular to the direction of oncoming traffic, is stackable without sticking or jamming, and is capable of accommodating multiple reflective sheeting configurations fully within recessed receiving panels on the delineator device. The vertical panel delineator further accommodates, in a secure manner, warning barricade lights of any known construction, and is uniquely capable of retaining secure engagement of the panel body with its ballasting base when being transported or during ordinary deployment, yet readily disengaging body and base upon impact by a vehicle.

28 Claims, 7 Drawing Sheets

VERTICAL PANEL TRAFFIC CHANNELIZER

This application claims the benefit under 35 U.S.C. 119(e) of the filing date of Provisional U.S. Application Ser. No. 60/780,087, entitled Vertical Panel Traffic Channelizer, filed on Mar. 7, 2006, and of the filing date of Provisional U.S. Application Ser. No. 60/898,202, entitled Vertical Panel Traffic Channelizer, filed on Jan. 29, 2007. Both of these prior provisional applications are expressly incorporated herein by reference.

BACKGROUND OF THE INVENTION

This invention relates to traffic safety devices and, more specifically, to vertical panel display systems.

Traffic safety delineators are extensively used at the present time to mark potential driving hazards, such as construction zones, lane closures, detours, potholes, etc., as well as to channelize traffic past such hazards. They are often used, as well, on sidewalks, bicycle paths, parking lots, indoor shopping malls, and the like to alert passersby to potential dangers, whatever the mode of transportation.

Vertical panels are well known in the prior art for use as vehicular traffic delineators. They are particularly useful in situations where space for lane closures is limited on the roadway and a full size circular channelizer (such as a drum) cannot be used. Vertical panel channelizers are most usually fabricated of polyethylene sheeting and have a minimum frontal surface area of 270 square inches as required by U.S. government standards, the frontal surface comprising alternating contrasting stripes (typically orange and white contrasting stripes) arranged in a diagonal pattern. This configuration has been shown to assist motorists in guiding their vehicles through the demarcated zone. Prior art vertical panels have a variety of problems, however, which prevent them from being ideally suited to their intended purpose. For example, if they are stackable (which is desirable to facilitate easier transportation and storage), they typically jam and stick, causing difficulty during deployment and often damaging the reflective sheeting displayed thereon. Additionally, they often fail to separate from their ballasting base upon vehicular impact, thus causing potential damage to the impacting vehicle, its occupants, and the delineator device, as well as causing the device to not be in compliance with governmental regulations in many localities. A further problem with prior art devices is that they are often structurally incapable of withstanding the stresses imposed thereon by high winds created by weather conditions or passing vehicles, particularly trucks.

SUMMARY OF THE INVENTION

The present invention addresses the problems with the prior art identified above, by providing an improved vertical panel delineator system which is capable of withstanding high winds without rotating from a preferred orientation wherein the full width of the device is perpendicular to the direction of oncoming traffic, is stackable without sticking or jamming, and is capable of accommodating multiple reflective sheeting configurations fully within recessed receiving panels on the delineator device. The invention further accommodates, in a secure manner, warning barricade lights of any known construction, and is uniquely capable of retaining secure engagement of the panel body with its ballasting base when being transported or during ordinary deployment, yet readily disengaging body and base upon impact by a vehicle.

More particularly, there is disclosed in the present invention a delineator for channelizing traffic, which comprises a body having a face for displaying a warning to passing motorists. The face includes a recessed area for accommodating reflective sheeting, wherein the recessed area comprises a first portion and a second portion. Each of the two recessed portions are contiguous. The first portion is trapezoidally shaped, and the second portion has a substantially constant width along its entire length, so that either trapezoidally shaped or rectangularly shaped reflective sheeting portions may be readily accommodated on the provided recessed area.

In another aspect of the invention, there is provided a delineator for channelizing traffic, which comprises a body having a face for displaying a warning to passersby, and a flange at a lower end thereof. Advantageously, the flange has a predetermined width and extends about a portion of a periphery of the lower end of the body, wherein a second portion of the periphery of the lower end of the body includes a flange having a second predetermined width substantially less than the predetermined width. In preferred embodiments, this second predetermined width is substantially zero. In other words, preferably the body comprises opposing faces joined by a pair of opposing ends to form the aforementioned periphery. The flange having the aforementioned predetermined width extends across each of the opposing faces, at the lower end of the body, while there is no flange extending across each of the opposing ends at the lower end of the delineator body.

In yet another aspect of the invention, there is disclosed a delineator for channelizing traffic, which comprises a body having opposing faces for displaying a warning to passersby, wherein the face has a plurality of stacking lugs disposed thereon. The stacking lugs comprise indentations extending inwardly from each of the faces toward a center-line of the body. The stacking lugs disposed on each of the opposing faces are disposed in a predetermined pattern, the predetermined pattern on each face being substantially identical and substantially co-located, so that corresponding ones of the lugs extending inwardly from each of the opposing faces approach one another to create a down stop in an interior of the body. This down stop prevents sticking and jamming when multiple ones of the described delineator are stacked one upon another.

In still another aspect of the invention, there is provided a delineator for channelizing traffic, which comprises a body having a face for displaying a warning to passersby. Edges are disposed on the body which define the face thereof. Along a first length extending from an upper end of the body each of the edges has a constant radius blending into a tangent flat surface for forming an end panel of the body. Along a second length extending from a lower end of the first length toward a bottom end of the body, each of the edges comprise a varying full radius.

The invention, together with additional features and advantages thereof, may best be understood by reference to the following description taken in conjunction with the accompanying illustrative drawing.

DESCRIPTION OF THE PREFERRED EMBODIMENT

Referring now more particularly to the drawings, there is shown in FIGS. 1-4 one embodiment of a vertical panel delineator 10 constructed in accordance with the principles of the present invention. The delineator 10 comprises a body 12 having opposing faces 14 for receiving reflective sheeting. In a preferred embodiment, the overall dimensions of the body 12 are 9⅛ inches×15¼ inches×43⅝ inches, with a material thickness of about 0.080 inches. Preferably, the body 12 is blow molded of either low or high density polyethylene (LDPE or HDPE, respectively). The body 12 has a weight of approximately 4.5 lbs without ballast, in the illustrated embodiment.

Figure 7:
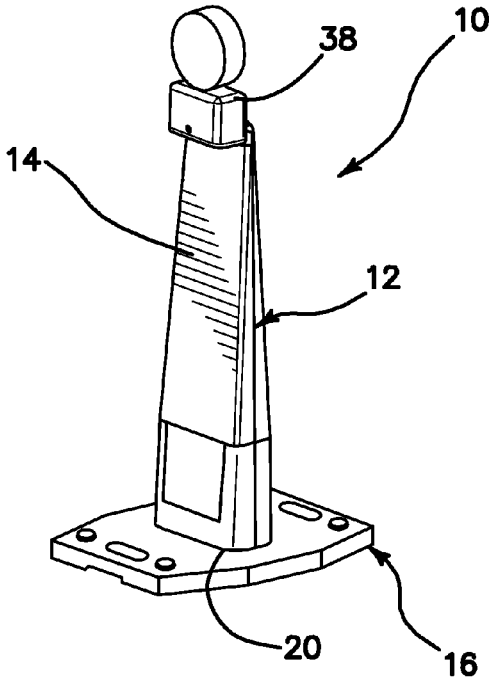
FIG. 7 is a perspective view of a vertical panel delineator constructed in accordance with the principles of the present invention, wherein a ballasting base and a warning light have been installed.
Figure 8:
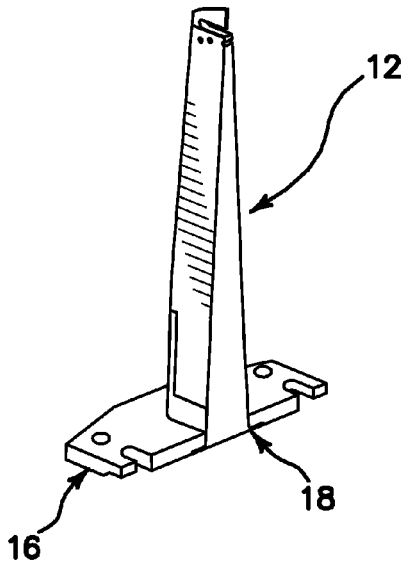
FIG. 8 is a cross-sectional view through a vertical panel delineator and ballasting base combination in accordance with the present invention, illustrating an engagement of a bottom flange of the vertical panel delineator with the ballasting base.

As shown in FIG. 7, for most applications a ballasting collar 16 is utilized to secure the delineator 10 in place. As illustrated, the ballasting collar 16 comprises a 201b or 301b base, fabricated of rubber. In a most preferred embodiment, the rubber comprises crumb rubber. As is known in the art, crumb rubber is formed from processed scrap vehicle tires mixed with a suitable binder. A plastic flange 18 is molded at the bottom end of the body 12 (FIGS. 1-4 and 8). When the collar 16 is dropped over the body 12 of the delineator 10, as shown in FIG. 7, it engages the flange 18, as shown in FIG. 8, thus preventing the delineator body 12 from pulling out through the opening 20 in the base.

Figure 1:
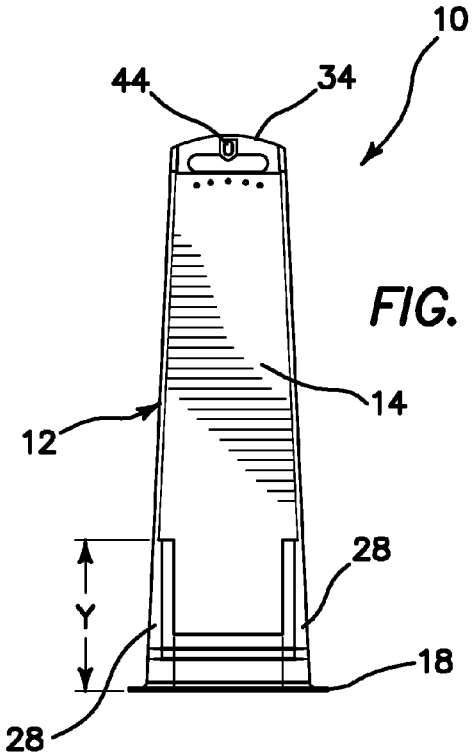
FIG. 1 is a frontal view of one embodiment of a vertical panel delineator constructed in accordance with the principles of the present invention.
Figure 2:
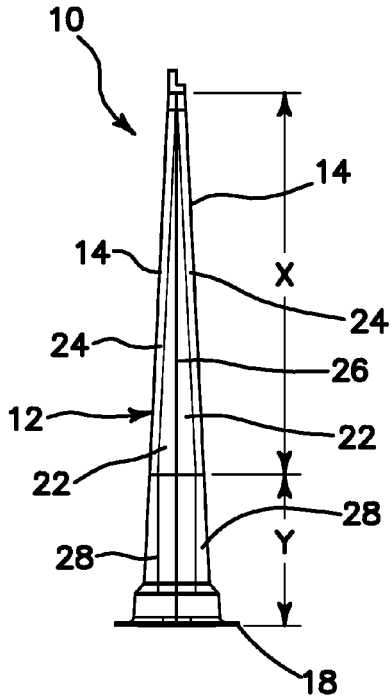
FIG. 2 is a side view of the vertical panel delineator of FIG. 1.
Figure 3:
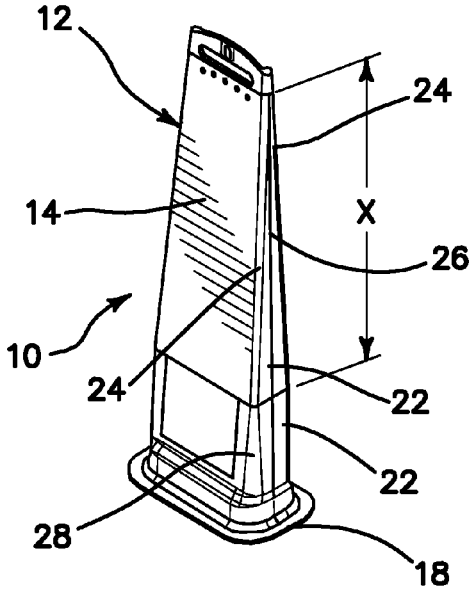
FIG. 3 is a perspective view of the vertical panel delineator of FIGS. 1 and 2.
Figure 4:
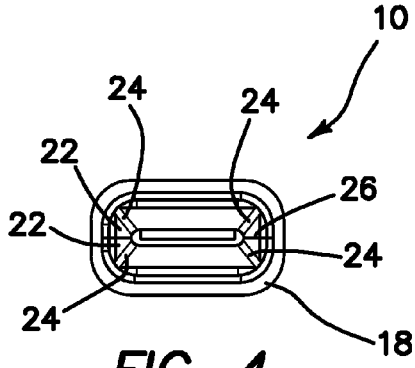
FIG. 4 is a top view of the vertical panel delineator of FIGS. 1-3.
Figure 5:
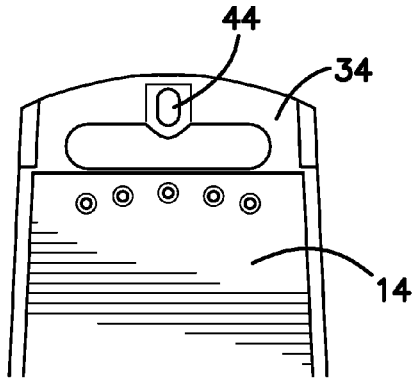
FIG. 5 is an enlarged frontal view of the upper portion of the vertical panel delineator of FIG. 1.

One important difference between the inventive delineator 10 and prior art devices is that the present delineator 10 comprises distinct edges which differentiate the inventive delineator from prior art delineators. As shown in FIGS. 2, 3, and particularly FIGS. 15-17, the upper portion of the body 12, along a distance denoted by the letter X, includes end panels 22 defined by edges 24 having a constant radius. In the illustrated embodiment, the constant radius is ½ inch, and the distance X is 30 inches, though these values can, of course, vary according to particular design parameters. Each constant radius edge 24 blends into one of the end panels 22, which comprises a tangent flat surface extending toward an apex, which corresponds with the mold parting line 26. On each end of the body 12, the two end panels 22 extending tangentially from each opposed edge 24 converge at the apex 26 to form an A-frame shape. The A-frame design adds strength to the side faces 14 of the delineator 10, thus enabling the plastic opposed side faces 14 to better distribute stress across the face when high winds create a force perpendicular to the panel's wide face.

The lower portion of the body 12, along a distance denoted by the letter Y, on the other hand, comprises edges 28 having a varying full radius, as also shown in FIGS. 2 and 3. This varying full radius is a transition zone between the constant radius along portion X of the body 12 and the flanged foot section 18. The transition area is designed to have a different radius from the point at which the constant radius area ends and the varying full radius area begins.

In a presently preferred embodiment of the invention, the lower portion of the body 12, along distance Y, is about 12 inches in length. In other words, Y equals 12 inches. Of course, this value can vary in accordance with design parameters and the particular delineator design. However, the distance Y will always be substantially smaller than the distance X, and preferably less than half of the distance X.

Figure 15:
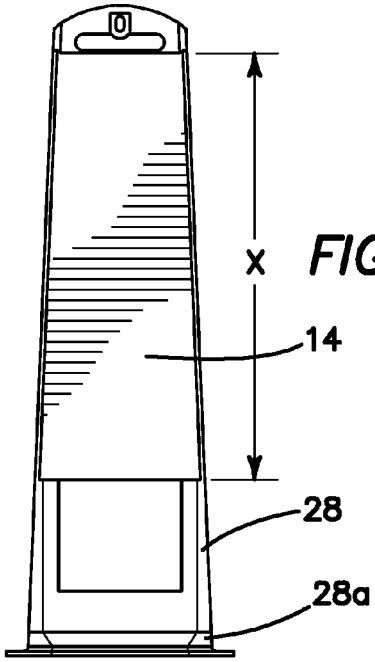
FIG. 15 is a frontal view of a vertical panel delineator of the present invention.
Figure 16:
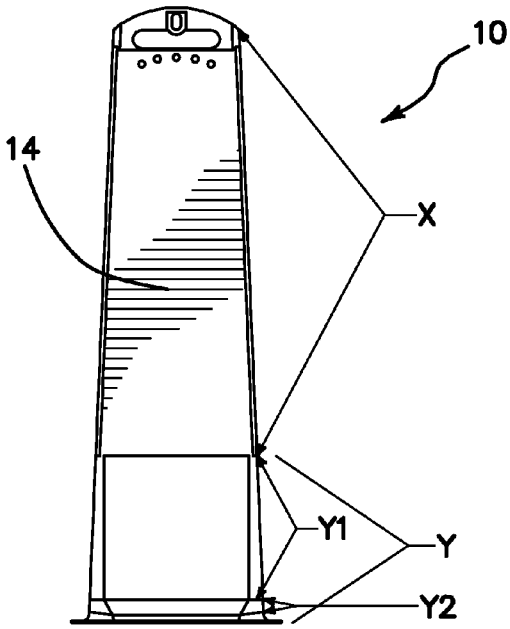
FIG. 16 is another frontal view of a vertical panel delineator of the present invention.
Figure 17:
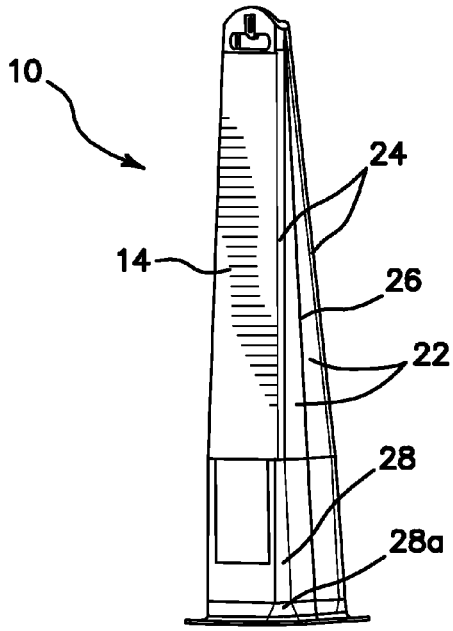
FIG. 17 is a perspective view of a vertical panel delineator of the present invention.
Figure 18:
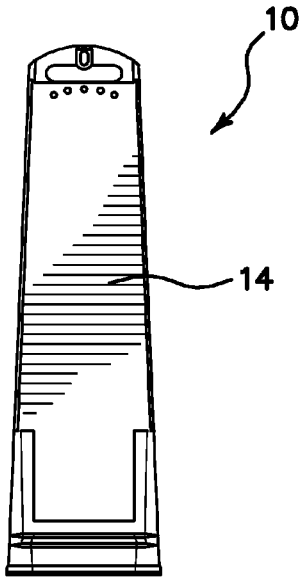
FIG. 18 is a frontal view, similar to FIG. 1, of a modified embodiment of the vertical panel delineator of the present invention.
Figure 19:
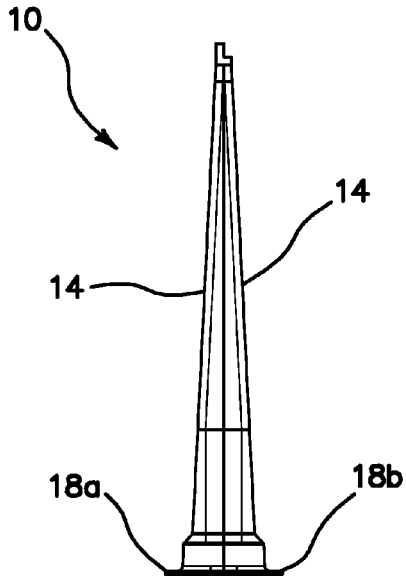
FIG. 19 is a side view, similar to FIG. 2, of the modified embodiment of FIG. 18.
Figure 20:
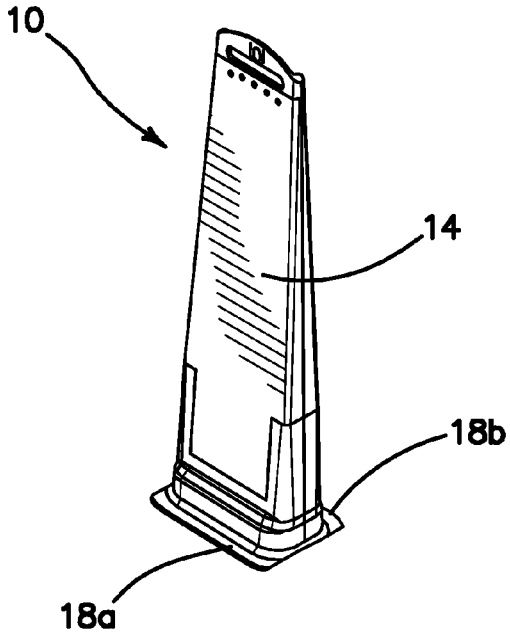
FIG. 20 is a perspective view, similar to FIG. 3, of the modified embodiment of FIG. 18.

With reference to FIGS. 15-17, in a particularly preferred embodiment, the distance Y actually comprises two portions, identified as Y1 and Y2 (FIG. 16). Along the distance Y1, as shown, edges 28 have a first diverging radius. Then, along the distance Y2, the edges 28*a* have a second diverging radius, which is greater than the first diverging radius of the edges 28. In a preferred embodiment, the distance Y2 is approximately 1½ inches upwardly from the flange 18, and the distance Y1 comprises the balance of the distance between the flange and the lower end of the region X. In the zone identified as Y1, the preferred radius diverges from about ½ inch to about 1⅝ inches. In the zone identified as Y2, the preferred radius diverges somewhat more sharply, from about 1⅝ inches to about 2¼ inches.

Figure 9:
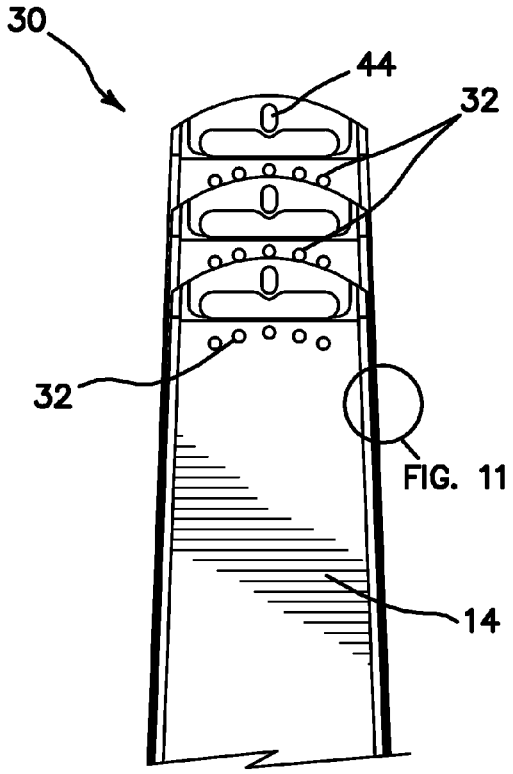
FIG. 9 is a frontal view of the upper portions of a plurality of vertical panel delineators of the present invention which are stacked together.
Figure 10:
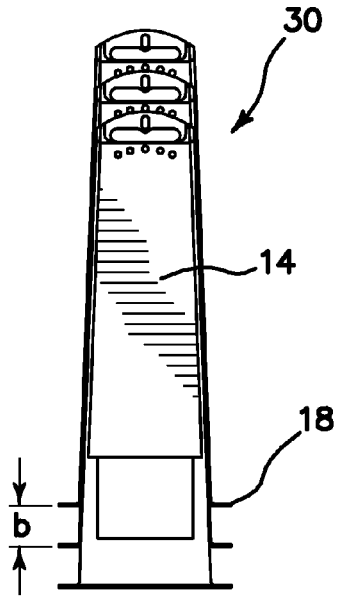
FIG. 10 is a frontal view showing the stacked vertical panel delineators of FIG. 9 in their entirety.
Figure 11:
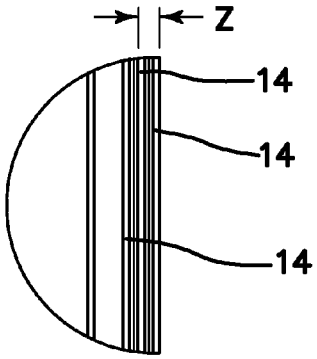
FIG. 11 is a detail view of the portion of FIG. 9 delineated by the reference letter A.

Now with reference to FIGS. 9-11, a plurality of delineators 10 are shown in a stacked configuration 30. Although three delineators are pictured, any number of delineators may be stacked one upon the other, as shown, with the proviso that the resulting stacked configuration 30 is capable of being transported and stored conveniently. Typically, prior art vertical panel delineators, when stacked in this manner, have a tendency to stick or jam, with the inside surface of one outer panel tending to stick or jam onto the outside corner of the inside panel immediately below in the stack. This sticking and jamming can cause damage to the wrapped around trapezoidal shaped sheeting and difficulty in deploying the delineators in a work zone, as the delineators are separated from one another by the worker. This difficulty can also be dangerous to the worker. Responsive to this prior art problem, the inventive delineator includes "kiss off" stacking lugs 32, deployed on the upper face 14 of the delineator body 12, as shown particularly in FIGS. 9 and 10, and in FIGS. 13 and 14. The stacking lugs 32 comprise a series of small circular indentations which are molded into each of the two opposing faces 14 on each delineator 10. In a preferred embodiment, five lugs 32 are molded into each face, as illustrated, and are patterned in a circular contour which matches a circular contour of a handle 34 of the delineator. In the aforementioned preferred embodiment, the circular contour pattern employed has a diameter of 9 inches. However, the number of lugs, and the pattern and size of the pattern employed, can be varied to some extent in accordance with design constraints and parameters.

Figure 13:
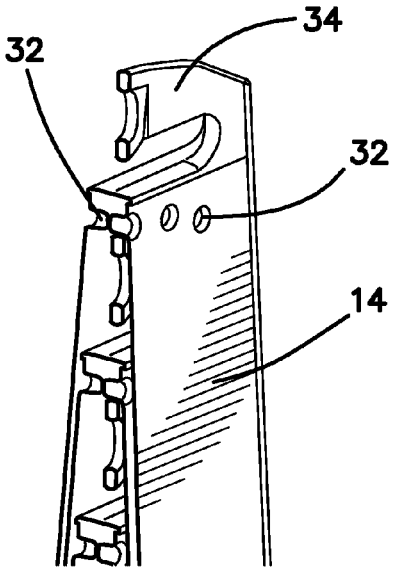
FIG. 13 is a perspective cut-away view of stacked vertical panel delineators of the invention.
Figure 14:
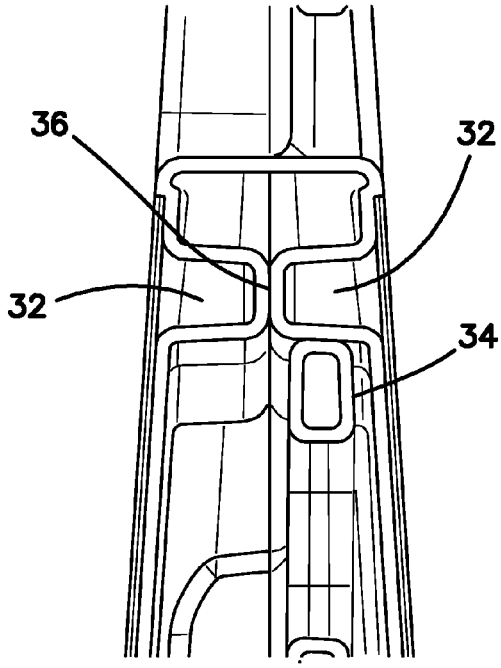
FIG. 14 is a close-up cut-away view, from the side, of the stacked vertical panel delineators of FIG. 13, showing the function of kiss-off stacking lugs employed thereon.

The stacking lugs 32 disposed on each face 14 of the delineator 10 extend inwardly from the face, preferably to or just short of a centerline of the molded body 12 (see FIGS. 13 and 14). Since the lugs are disposed on each opposing face, in the same pattern, the individual lugs will meet or nearly meet corresponding lugs from the opposing face at the centerline, thus creating a wall or down stop 36 within the body 12. Thus, when multiple delineators 10 are stacked in the configuration 30 shown in FIGS. 9 and 10, the handle 34 of the lower delineator 10 will abut the down stop 36 formed by the stacking lugs 32 of the higher delineator, thus stopping further downward movement of the higher delineator onto the lower delineator. This, in turn, permits a spacing to occur between adjacent faces 14 of the stacked delineators, as shown in FIG. 11, thereby preventing sticking or jamming of the delineators, and resultant damage to the reflective material disposed on the faces 14. In the illustrated preferred embodiment, this distance or spacing z between adjacent faces 14 is about 0.100 inches, though the spacing may be varied in accordance with design conventions, as long as the interior wall of the outside delineator does not contact the face 14 of the interior adjacent delineator. Also, in the illustrated embodiment, a preferred spacing b between adjacent flanges (FIG. 10) is approximately 3.80 inches, as a result of the action of the stacking lugs 32. Again, though sufficient spacing between the flanges is required to separate the face 14 of the interior delineator from the inside wall of the body 12 of the adjacent outer delineator, the actual spacing b between adjacent flanges can vary within these design parameters.

Figure 12:
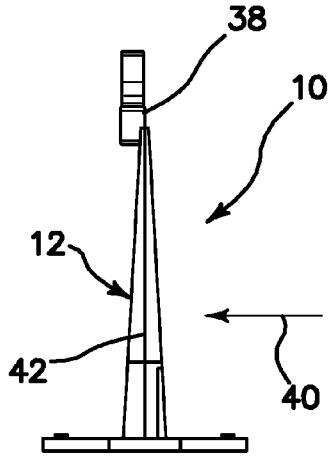
FIG. 12 is a side view of the vertical panel delineator of FIG. 8.

As shown in FIGS. 7 and 12, an important design feature of the present invention is its ability to safely accept the mounting of a barricade light 38 to the top handle 34 of the delineator 10. As shown in FIG. 12, the barricade light 38 is mounted so that it is disposed behind the delineator 10, relative to the direction of oncoming vehicular traffic, as depicted by arrow 40. To assist in accommodating the barricade light 38, the delineator 10 is made symmetrical about its parting line 26 from its base upwardly to a point corresponding to the top of the opposing faces 14 (about 40¾ inches in the preferred embodiment). This creates the entire area for any desired reflective sheeting, as well as the flange 18 for attaching the body 12 to the base or ballasting collar 16.

Figure 6:
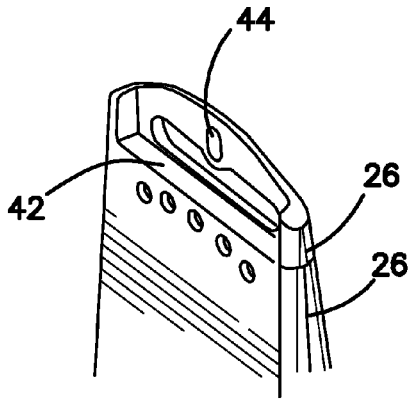
FIG. 6 is a perspective view of the upper portion of the vertical panel delineator of FIG. 5.

At the point at which the parting line 26 reaches the handle 34, the parting line 26 offsets a predetermined distance, as shown best in FIG. 6. In the preferred embodiment, the offset distance is about ¼ inches. This offset creates a molded-in shelf 42 (also shown in FIG. 6) on which the barricade light may be securely mounted. In the preferred embodiment, the shelf 42 is approximately ⅝ inches deep, and the drop-off parting line 26 occurs along the upper 2 13/16 inches of the delineator 10.

A slotted mounting hole 44 is provided in the handle 34 for mounting the barricade light 38. The slotted hole 44 is oriented in a vertical direction in order to accommodate varying bolt hole locations in the many different available barricade light housings. The slotted hole is specifically designed to accommodate a ½ inch bolt and to permit ½ inches of adjustment in the vertical direction. This compensates for variations in the centerline distance from the mounting bolts to the bottom of the battery case for the barricade light being employed.

A particularly important feature of the present invention is described in a modified embodiment shown in FIGS. 18-22. This embodiment is substantially similar in every respect to the embodiment of FIG. 1, except as described below. Applicants have found a problem, in practice, with prior art traffic safety devices having a flange which extends completely about the periphery of the device (i.e. a 360 degree flange). The problem is that sometimes the body of such a device does not separate from the ballasting base with which it is engaged upon impact by a passing vehicle. Governmental regulations in many localities require such separation, in order to minimize damage to the vehicle and its occupants. Separation of the plastic body of the delineator from its ballasting base also minimizes damage to the plastic body.

Thus, in the illustrated embodiment, rather than a continuous flange 18, there is provided a front flange 18*a* and a rear flange 18*b*. The side portions of the flange 18 (FIG. 1 embodiment) have been removed. This is most clearly seen by comparing FIGS. 4 and 21 of the application. This design modification may be accomplished by either a mold change, so that the side portions of flange 18 (FIG. 4) are never produced, or by trimming the side portions of the flange 18 off in a subsequent trimming step after the molding step.

Figure 22:
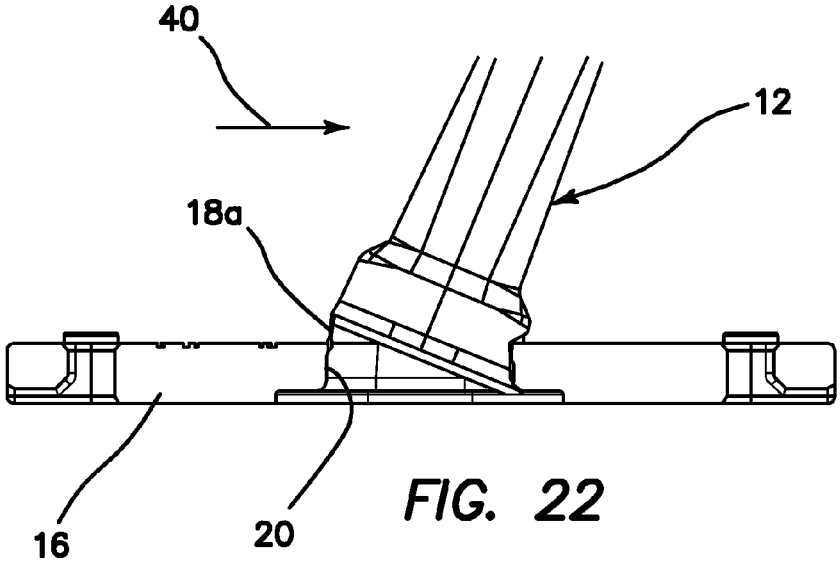
FIG. 22 is a cross-sectional view of the engagement between a base flange of the vertical panel delineator of the present invention and a ballasting base, showing disengagement of the delineator from the base.

Functionally, the removal of the side portions of the flange 18 permits the front and rear flanges 18*a* and 18*b*, respectively, to function independently, as living hinges, free of influence from side flange portions. With the front and rear flanges flexing independently, the delineator 10 is more readily permitted to release from the base 16, as shown in FIG. 22, pulling through the center opening 20 of the base. In FIG. 22, the flange 18*a* is shown in such a flexed position. The reduced force and binding on the delineator, as it is pulled through the base opening 20, minimizes the chance of damage to the panel or base. Using this approach, Applicants have surprisingly found that the best of both worlds is achieved. The engagement remains sufficient to ensure that the body 12 remains in place once disposed in a desired location along a roadway, and to ensure that the body remains secured to the base 16 while the device is being dragged to or from its desired location. Yet, upon vehicular impact, the body and base are readily separated, as is desired.

Figure 21:
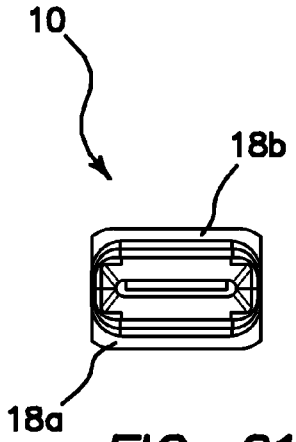
FIG. 21 is a top view, similar to FIG. 4, of the modified embodiment of FIG. 18.

The illustration of a preferred embodiment in FIGS. 18-22 does not exclude modifications thereof. For example, although the side portions of the flange 18 of the FIG. 4 embodiment are shown as being completely eliminated, the real key is simply that they are substantially reduced in width. Thus, the flange 18 has a substantially constant width W around its entire periphery in the FIG. 4 embodiment, as is the standard in the prior art for these types of devices. However, in the embodiment of FIGS. 18-22, the width W of the side portions of flange 18 is substantially reduced, at least by about half, to gain substantial living hinge functionality of the present invention. Eliminating the side flanges entirely, as shown in FIG. 21, enhances the improved effects.

Figure 23:
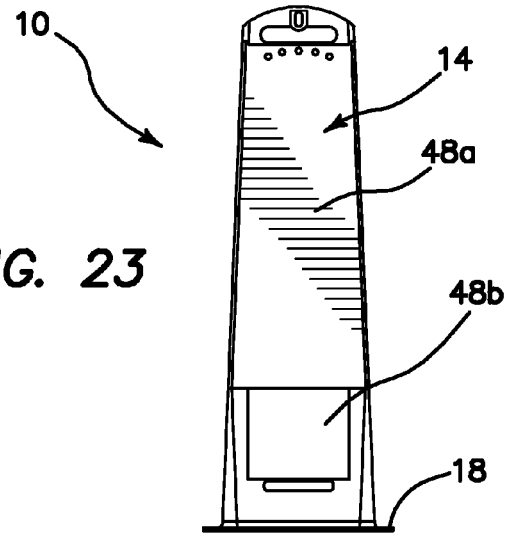
FIG. 23 is a frontal view of a generic embodiment of the present invention, illustrating two preferred configurations for accommodating retro-reflective sheeting on the delineator.
Figure 24:
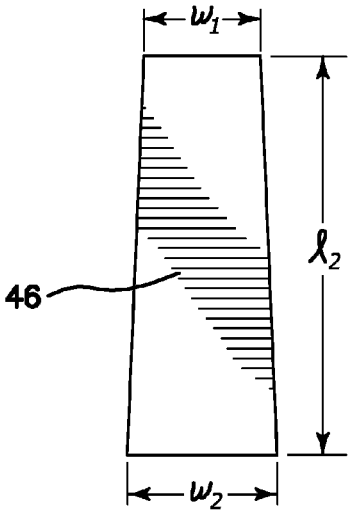
FIG. 24 shows a trapezoidally shaped configuration for retro-reflective sheeting.
Figure 25:
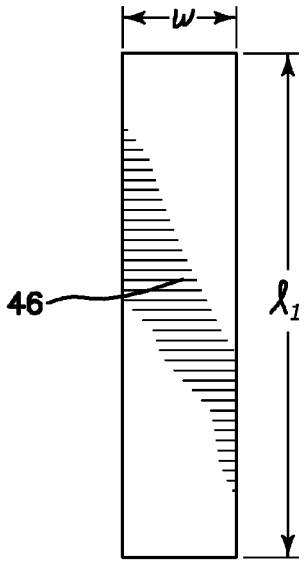
FIG. 25 shows a rectangularly shaped configuration for retro-reflective sheeting.

FIGS. 23-25 illustrate the unique reflective material display aspects of the present invention. According to current U.S. government regulations, all vertical panels must display a minimum of 270 square inches of retro-reflective sheeting applied to the front panel face 14 facing perpendicular to oncoming vehicular traffic. In order to meet this standard, two shape configurations for reflective sheeting 46 have been used within the highway safety industry. The primary shape is a rectangular shape, as illustrated in FIG. 25, wherein the width w is 8 inches, and the length $l_1$ is 36 inches. The second type of shape available is a trapezoidal shape as shown in FIG. 24. This shape typically has a length $l_2$ of 29½ inches, a top width $w_1$ of 8³⁄₁₆ inches, and a bottom width $w_2$ of 10⅝ inches. However, in prior art vertical panels, currently, only a recessed face for the aforementioned rectangular shape is accommodated.

A consequence of excluding a trapezoidal recessed face on prior art vertical panels is that the sheeting shape that fits into the available rectangular recess is only the shape of the rectangle. The trapezoidal shaped sheeting on competitive devices lies partly within the available recessed area, but the edges of the wider trapezoidal sheeting must be wrapped about the edge of the device and extended onto the side panels thereof. These extensions are not visible to oncoming motorists. To address this problem, which potentially could be dangerous and make the device non-compliant when trapezoidal sheeting is utilized, the invention provides a recessed panel which accommodates either rectangular or trapezoidal reflective sheeting. This dual recess shape allows the user in different geographical areas, having different regulatory specifications for retro-reflective sheeting application to use the compliant sheeting of their choice.

FIG. 23 illustrates the recessed area 48 of the panel 14, which comprises an upper recessed portion 48*a* and a lower recessed portion 48*b*. The lower end of the recessed portion 48*a* has a width at least equal to (and preferably slightly greater than) the width w2, while the length of the recessed portion 48*a* is at least equal to (and preferably slightly greater than) the length $l_2$. The combined length of recessed portions 48*a* and 48*b* is at least equal to (and preferably slightly greater than) the length $l_1$.

Accordingly, although an exemplary embodiment of the invention has been shown and described, it is to be understood that all the terms used herein are descriptive rather than limiting, and that many changes, modifications, and substitutions may be made by one having ordinary skill in the art without departing from the spirit and scope of the invention.

What is claimed is:

1. A delineator for channelizing traffic, comprising:

a body having a face for displaying a warning to passersby, said face including a recessed area for accommodating reflective sheeting, said recessed area comprising a first portion and a second portion, wherein the two recessed portions are contiguous, with the first portion being disposed above the second portion;

wherein the first portion is trapezoidally shaped and is defined by protruding edges disposed along at least three full sides of the trapezoid and portions of the fourth trapezoidal side, and the second portion has a width and a length, the width of the second portion being substantially constant along the entire length of the second portion wherein the second recessed portion is defined by protruding edges disposed along at least three full sides of the second portion, and portions of the fourth side thereof;

whereby the recessed portions of said delineator face are adapted to accommodate reflective sheeting having a minimum display area of 270 square inches and having either a rectangular shape or a trapezoidal shape.

2. The delineator as recited in claim 1, said delineator body further comprising:

a handle at a top end of the body, said handle including a mounting hole for attaching a barricade light to the handle; and a molded shelf disposed on said body beneath the mounting hole, for providing a secure support for said barricade light.

3. The delineator as recited in claim 1, said delineator body having a flange at a lower end thereof;

said flange having a first predetermined width and extending about a first portion of a periphery of the lower end of said body, wherein a second portion of the periphery of the lower end of said body includes a flange having a second predetermined width substantially less than said first predetermined width.

4. The delineator as recited in claim 3, wherein said second predetermined width is substantially zero.

5. The delineator as recited in claim 4, wherein said body comprises opposing faces joined by a pair of opposing ends to form said periphery, said flange having said first predetermined width extending across each of said opposing faces;

wherein there is no flange extending across each of said opposing ends at the lower end of the delineator.

6. The delineator as recited in claim 1, wherein said face has a plurality of stacking lugs disposed thereon, said stacking lugs comprising indentations extending inwardly from said face toward a center-line of said body;

wherein the stacking lugs disposed on said face are disposed in a predetermined pattern, and extend inwardly from said face to create a down stop in an interior of said body, thus preventing sticking and jamming when multiple ones of said delineator are stacked one upon another.

7. The delineator as recited in claim 1, and further comprising edges disposed on said body defining said face;

wherein along a first length extending from an upper end of said body, each of said edges has a constant radius blending into a tangent flat surface for forming an end panel of said body; and along a second length extending from a lower end of said first length toward a bottom end of said body, each of said edges comprises a varying full radius.

8. A delineator for channelizing traffic, comprising:

a body having a face for displaying a warning to passersby, and a flange at a lower end thereof;

said flange having a first predetermined width and extending about a first portion of a periphery of the lower end of said body, wherein a second portion of the periphery of the lower end of said body includes a flange having a second predetermined width substantially less than said first predetermined width; and a ballasting collar having an opening therein, said collar being adapted to fit over said body and to rest on said flange.

9. The delineator as recited in claim 8, wherein said second predetermined width is substantially zero.

10. The delineator as recited in claim 9, wherein said body comprises opposing faces joined by a pair of opposing ends to form said periphery, said flange having said first predetermined width extending across each of said opposing faces;

wherein there is no flange extending across each of said opposing ends at the lower end of the delineator.

11. The delineator as recited in claim 8, wherein said face has a plurality of stacking lugs disposed thereon, said stacking lugs comprising indentations extending inwardly from said face toward a center-line of said body;

wherein the stacking lugs disposed on said face are disposed in a predetermined pattern, and extend inwardly from said face to create a down stop in an interior of said body, thus preventing sticking and jamming when multiple ones of said delineator are stacked one upon another.

12. The delineator as recited in claim 8, and further comprising edges disposed on said body defining said face;

wherein along a first length extending from an upper end of said body, each of said edges has a constant radius blending into a tangent flat surface for forming an end panel of said body; and along a second length extending from a lower end of said first length toward a bottom end of said body, each of said edges comprises a varying full radius.

13. The delineator as recited in claim 8, said delineator body further comprising:

a handle at a top end of the body, said handle including a mounting hole for attaching a barricade light to the handle; and a molded shelf disposed on said body beneath the mounting hole, for providing a secure support for said barricade light.

14. The delineator as recited in claim 8, wherein said ballasting collar is disposed on said flange and surrounds said delineator body, thereby functioning to ballast said delineator in place.

15. The delineator as recited in claim 8, wherein said second predetermined width is less than or equal to one-half of the magnitude of said first predetermined width.

16. A delineator for channelizing traffic, comprising:

a body having opposing faces for displaying a warning to passersby, each of said faces having a plurality of stacking lugs disposed thereon, said stacking lugs comprising indentations extending inwardly from each of said faces toward a center-line of said body;

wherein the stacking lugs disposed on each of said opposing faces are disposed in a predetermined pattern, the predetermined pattern on each face being substantially identical and substantially co-located, so that corresponding ones of the lugs extending inwardly from each of said faces approach one another to create a down stop in an interior of said body, thus preventing sticking and jamming when multiple ones of said delineator are stacked one upon another.

17. The delineator as recited in claim 16, and further comprising edges disposed on said body defining said face;

wherein along a first length extending from an upper end of said body, each of said edges has a constant radius blending into a tangent flat surface for forming an end panel of said body; and along a second length extending from a lower end of said first length toward a bottom end of said body, each of said edges comprises a varying full radius.

18. The delineator as recited in claim 16, said delineator body further comprising:

a handle at a top end of the body, said handle including a mounting hole for attaching a barricade light to the handle; and a molded shelf disposed on said body beneath the mounting hole, for providing a secure support for said barricade light.

19. The delineator as recited in claim 16, wherein said predetermined pattern comprises a generally circular contour.

20. The delineator as recited in claim 19, wherein said delineator body further comprises a handle extending from a top end of the body which has a generally circular contour, and the generally circular contour of said handle being configured to substantially match the generally circular contour of the predetermined pattern of stacking lugs.

21. The delineator as recited in claim 16, wherein said delineator comprises a first delineator and said first delineator body defining a hollow interior space, a second delineator having a substantially identical construction as said first delineator being disposed in a stacking relationship over said first delineator so that an upper portion of said first delineator is disposed within the hollow interior space defined by the second delineator body, a top end of a handle engaging the stacking lugs disposed on said second delineator body, thus preventing further movement of the first delineator handle upwardly into the hollow interior space of the second delineator body.

22. A delineator for channelizing traffic, comprising:

a body having a face for displaying a warning to passersby; and edges disposed on said body defining said face;

wherein along a first length extending from an upper end of said body, each of said edges has a constant radius blending into a tangent flat surface for forming an end panel of said body; and along a second length extending from a lower end of said first length toward a bottom end of said body, each of said edges comprises a varying full radius.

23. The delineator as recited in claim 22, said delineator body further comprising:

a handle at a top end of the body, said handle including a mounting hole for attaching a barricade light to the handle; and a molded shelf disposed on said body beneath the mounting hole, for providing a secure support for said barricade light.

24. The delineator as recited in claim 22, wherein said second length is substantially less than said first length.

25. The delineator as recited in claim 24, wherein said second length is less than one-half of said first length.

26. The delineator as recited in claim 25, wherein said second length is further divided into a lower length and an upper length, and wherein the edges along the upper length have a first diverging radius and the edges along the lower length have a second diverging radius.

27. The delineator as recited in claim 26, wherein the second diverging radius is greater than the first diverging radius.

28. The delineator as recited in claim 27, wherein the first diverging radius diverges from about ½ inch to about 1⅝ inches, and the second diverging radius diverges from about 1⅝ inches to about 2¼ inches.

* * * * *